US008758063B2

(12) United States Patent
Zhang

(10) Patent No.: US 8,758,063 B2
(45) Date of Patent: Jun. 24, 2014

(54) ELECTRICAL CONNECTOR HAVING A CONTACT MODULE WITH ONE SET OF TERMINALS INSERT MOLDED AND A SECOND SET SEPARATELY MOUNTED

(75) Inventor: Zhi-Cheng Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 11 days.

(21) Appl. No.: 13/542,611

(22) Filed: Jul. 5, 2012

(65) Prior Publication Data

US 2013/0017730 A1 Jan. 17, 2013

(30) Foreign Application Priority Data

Jul. 14, 2011 (CN) ..... 2011 1 0197194

(51) Int. Cl.
*H01R 24/00* (2011.01)

(52) U.S. Cl.
USPC ..... 439/676

(58) Field of Classification Search
USPC ..... 439/676, 630–637
See application file for complete search history.

(56) References Cited

U.S. PATENT DOCUMENTS

| | | | | |
|---|---|---|---|---|
| 5,599,209 | A * | 2/1997 | Belopolsky | 439/676 |
| 5,639,266 | A * | 6/1997 | Patel | 439/676 |
| 5,791,942 | A * | 8/1998 | Patel | 439/637 |
| 5,938,479 | A * | 8/1999 | Paulson et al. | 439/676 |
| 6,120,330 | A | 9/2000 | Gwiazdowski | |
| 6,267,628 | B1 * | 7/2001 | Meckley et al. | 439/676 |
| 6,276,971 | B1 * | 8/2001 | Belopolsky | 439/676 |
| 6,729,914 | B2 | 5/2004 | Jaouen | |
| 6,994,594 | B2 | 2/2006 | Milner et al. | |
| 7,241,157 | B2 * | 7/2007 | Zhuang et al. | 439/188 |
| 2009/0130913 | A1 * | 5/2009 | Yi et al. | 439/676 |
| 2010/0248545 | A1 * | 9/2010 | Lin et al. | 439/607.04 |

* cited by examiner

*Primary Examiner* — Chandrika Prasad
(74) *Attorney, Agent, or Firm* — Wei Te Chung; Ming Chieh Chang

(57) ABSTRACT

An electrical connector includes a housing (10) having a receptacle (14) for insertion of a plug connector and a contact module (20) inserted into the receptacle. The contact module having an insulative part (1), a first set of terminals (21) insert molded with the insulative part and a second set of terminals (22) separately mounted to the insulative part. Each of the first and second terminals has one end (211, 221) for mounting to an exterior substrate and another free end (215, 225). The free ends of the first terminals and the free ends of second terminals substantially extending along two opposite directions, respectively.

19 Claims, 6 Drawing Sheets

ELECTRICAL CONNECTOR HAVING A CONTACT MODULE WITH ONE SET OF TERMINALS INSERT MOLDED AND A SECOND SET SEPARATELY MOUNTED

BACKGROUND OF THE INVENTION

1. Field of the Invention

The present invention relates to an electrical connector, and more particularly to an electrical connector for use in the high frequency signals.

2. Description of Related Art

U.S. Pat. No. 5,791,942 issued to Anila Patel et al. on Aug. 11, 1998 discloses an electrical connector comprising a housing and a contact module inserted into the housing. The housing has a receptacle for insertion of a plug connector. The contact module has an insulative part, a set of first terminals, and a set of second terminals. The first and second terminals are inserted separately and retained in the insulative part. Each of the first and second terminals has one end for mounting to an exterior substrate and another free end. The free ends of first terminals and the free ends of second terminals substantially extend along two opposite directions, respectively. It is difficult to insert the first and second terminals into the insulative part and the retention is also unstable.

Hence, an electrical connector having a simple structure for assembling and stable terminal retention is desired.

SUMMARY OF THE INVENTION

Accordingly, an object of the present invention is to provide an electrical connector having a simple structure for assembling and stable terminal retention.

In order to achieve the object set forth, the invention provide an electrical connector comprising: a housing having a receptacle for insertion of a plug connector; and a contact module inserted into the receptacle, the contact module having an insulative part, a set of first terminals insert molded with the insulative part and a set of second terminals separately mounted to the insulative part, each of the first and second terminals having one end for mounting to an exterior substrate and another free end, the free ends of the first terminals and the free ends of the second terminals substantially extending along two opposite directions, respectively. The first terminals are retained in the insulative part by insert molding for stable retention, and the second terminals are mounted to the insulative part for easy manufacture.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
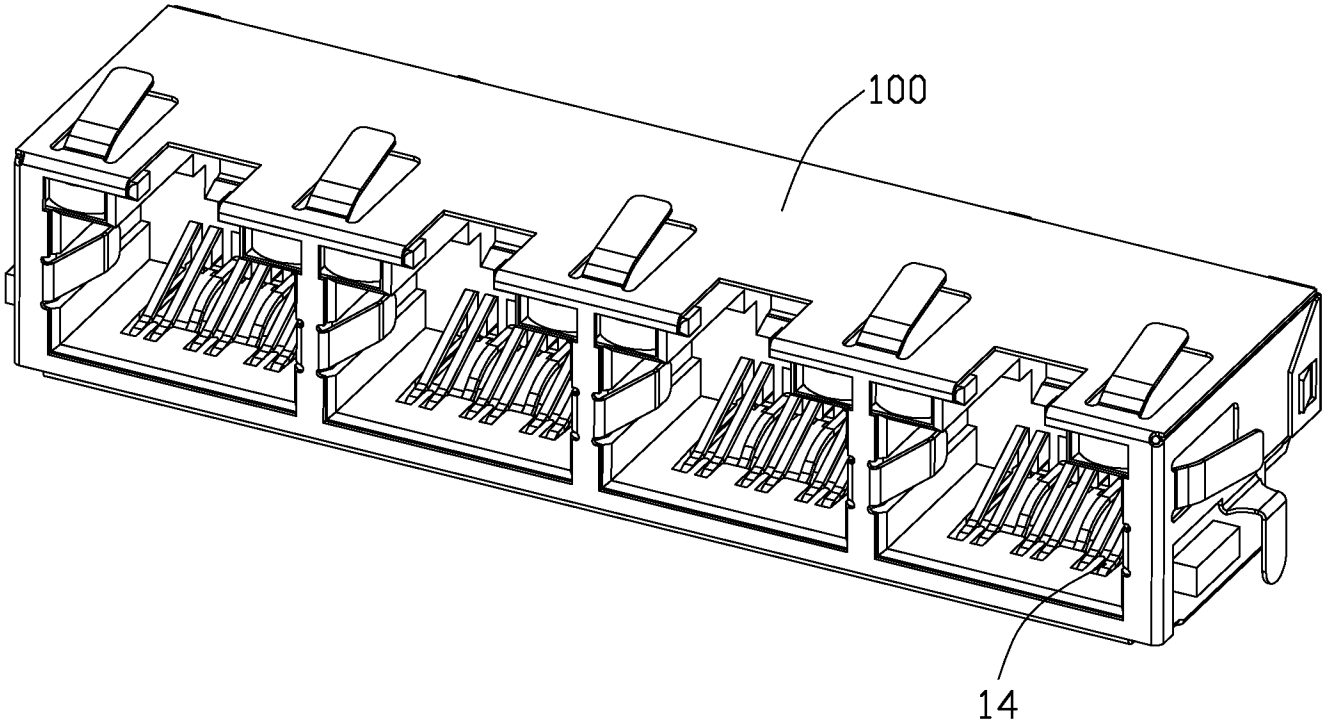
FIG. 1 is a perspective view of an electrical connector according to the present invention.
Figure 2:
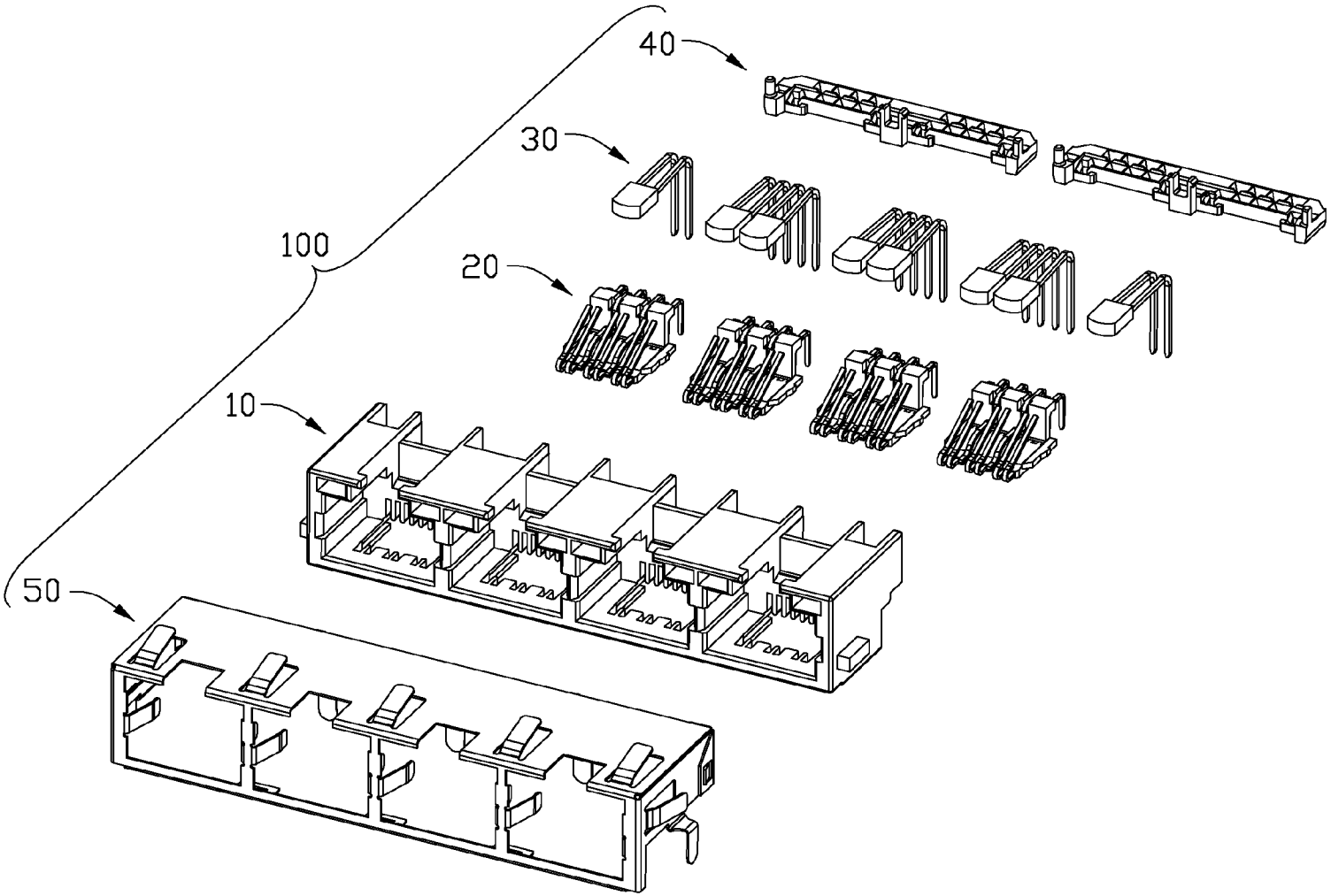
FIG. 2 is an exploded view of the electrical connector shown in FIG. 1.
Figure 3:
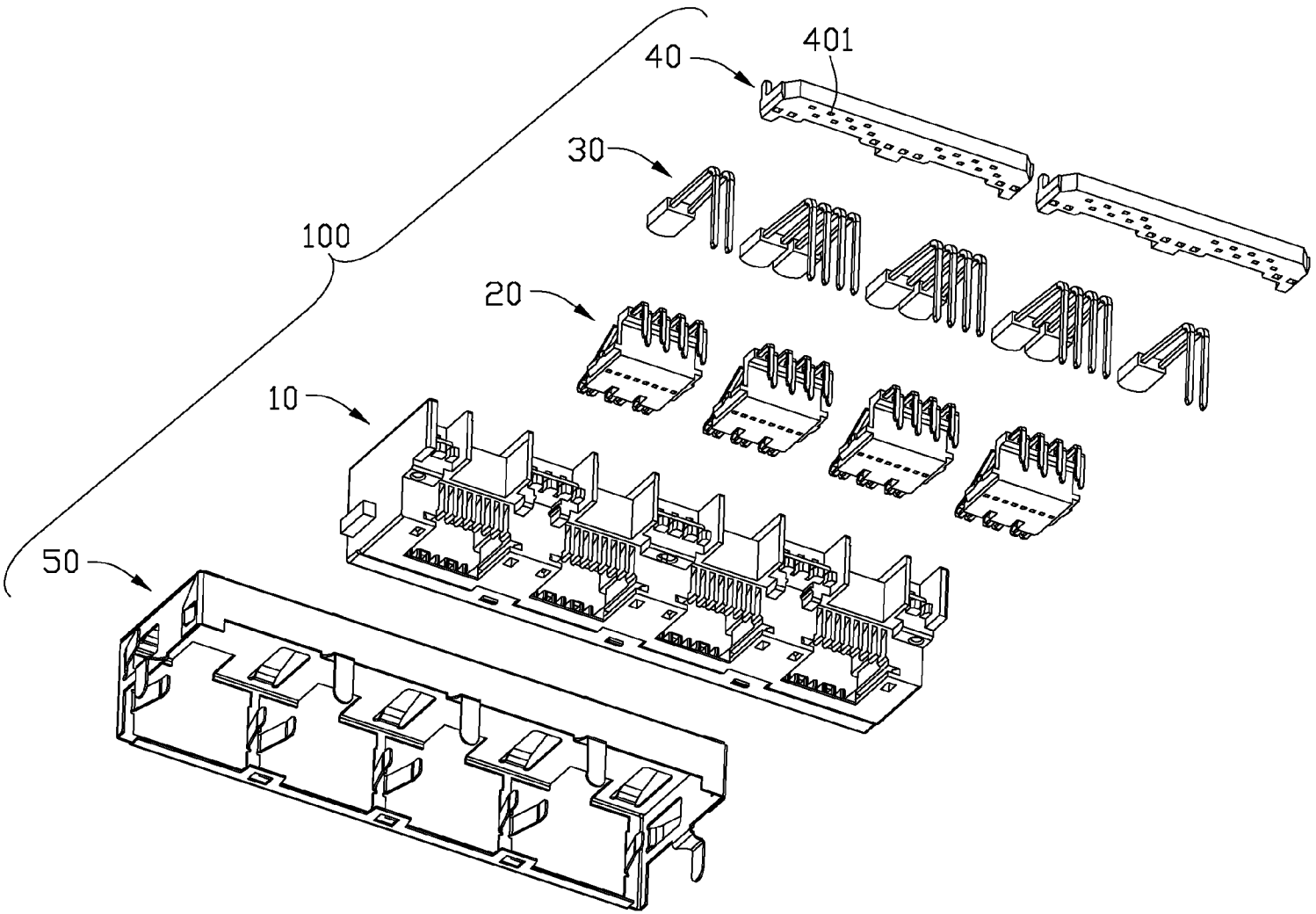
FIG. 3 is another exploded view of the electrical connector shown in FIG. 1.

Referring to FIGS. 1-3, a 1×4-port electrical connector 100 (modular jack) according to the present invention is shown. The electrical connector 100 could be mounted on an exterior substrate. The electrical connector 100 has an insulative housing 10, a contact module 20, a plurality of LEDs 30, a spacer 40 and a shield shell 50. The housing 10 has a row of receptacles 14 for receiving modular plugs. The contact module 20 is assembled to the housing 10 along a back-to-front direction and inserted into the receptacle 14. The LEDs 30 is also assembled to the housing 10 along the back-to-front direction. The spacer 40 with a plurality of holes 401 is assembled to the housing along a bottom-to-top direction. The shield shell 50 covers the housing 10.

Figure 4:
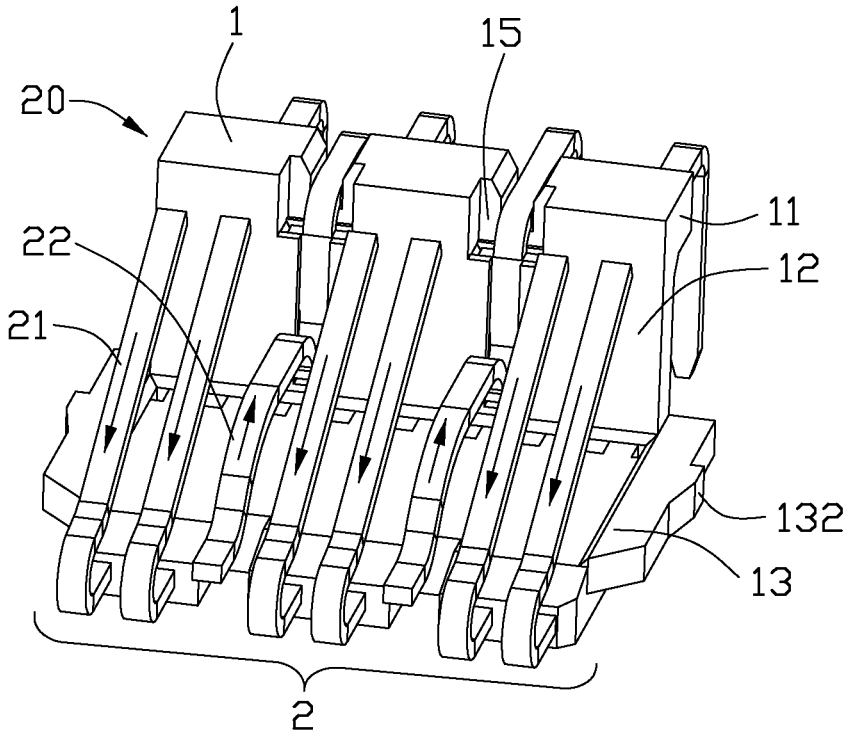
FIG. 4 is a perspective view of a contact module seen in FIG. 1.
Figure 5:
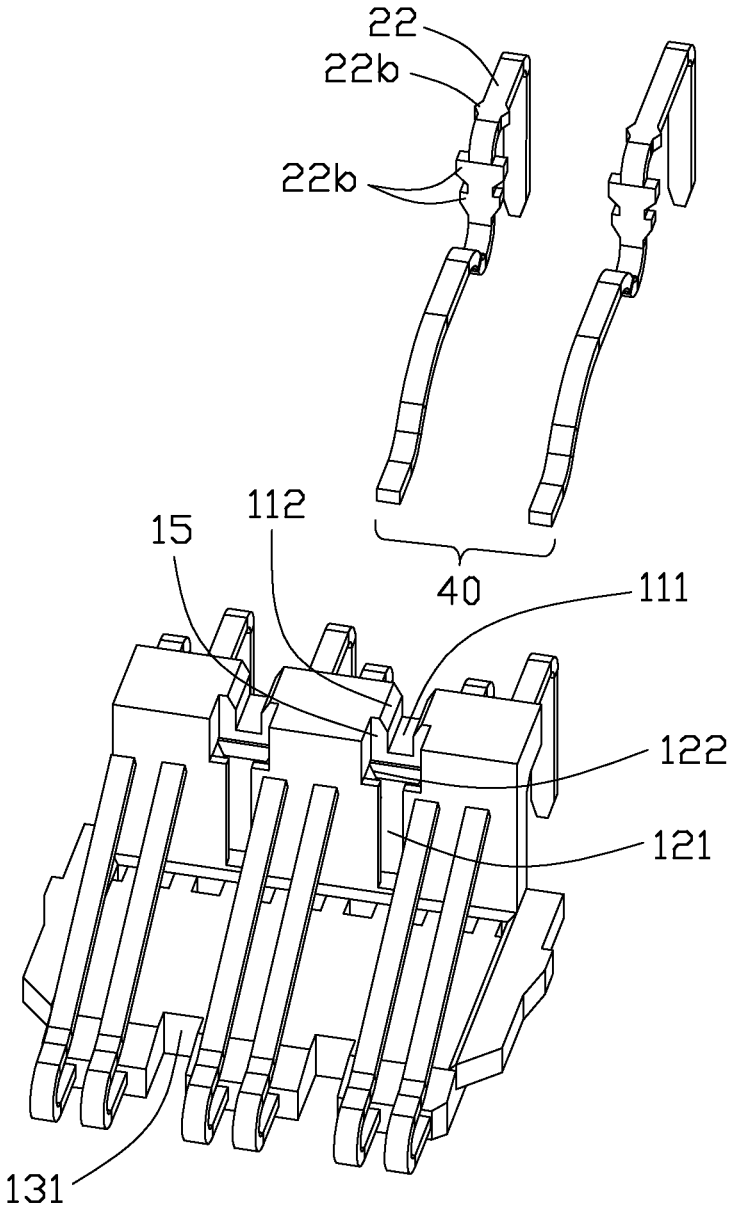
FIG. 5 is a partly exploded view of the contact module seen in FIG. 4.
Figure 6:
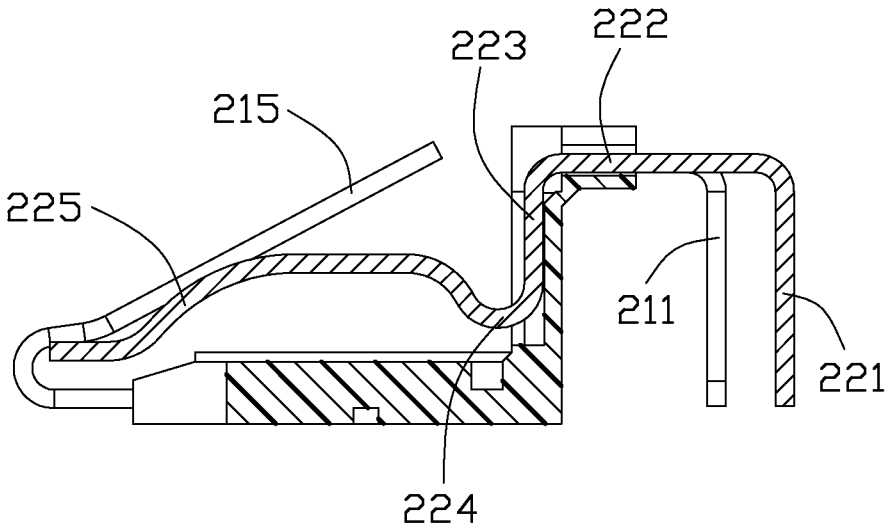
FIG. 6 is a cross-sectional view of the electrical connector shown in FIG. 1, taken along line 6-6.

Referring to FIGS. 4-6, the contact module 20 includes an insulative part 1 and a plurality of terminals 2 retained in the insulative part 1. The terminals 2 includes a set of first terminals 21 insert molded with the insulative part 1 and a set of second terminals 22 assembled to the insulative part 1 along a top-to-bottom direction. The insulative part 1 is disposed as Z shaped and has a top portion 11, a bottom portion 13 and a middle portion 12 positioned therebetween. The top portion 11 has a slot 111 penetrating a surface of the top portion 11. The slot 111 faces upwardly and extends in a front-to-back direction. The middle portion 12 has a slot 121 penetrating a surface of the middle portion 12. The slot 121 faces forwardly and extends in the top-to-bottom direction. The second terminal 22 has barbs 22*b* received in the slots 111,121 and engaging with the insulative part 1. The insulative part 1 also has a notch 15 positioned at an edge thereof between the top portion 11 and the middle portion 12, and the notch 15 is wider than the slots 111,121 for easy insertion of the set of second terminals 22. The top portion 11 has a chamfer 112 extending along the slot 111. The middle portion 12 has a chamfer 112 disposed at the top side of the slot 121. The chamfer 112,121 is set for easy insertion of the barbs 22*b*.

The second terminal 22 has an end portion 221 for mounting to the exterior substrate, a horizontal portion 222 received and retained in the slot 111, a vertical portion 223 received and retained in the slot 121, a bent portion 224, and a free end 225. The bent portion 224 protrudes toward the bottom portion 13 and extends upwardly away the bottom portion 13 to connecting with the free end 225. The free end 225 extends forwardly from the bending portion 224 and has a contact portion for contacting with the plug connector. The bent portion 224 could improve the second terminal's elastic deformation ability. The first terminal 21 has an end portion 211 for mounting to the exterior substrate, a buried portion (not shown) buried in the top, middle and bottom portions 11, 12, 13 and a free end 215 extending from the buried portion. The free end 215 extends backwardly from the buried portion and has a contact portion for contacting with the plug connector. The horizontal portion 222 and vertical portion 223 have the barbs 22*b*.

The first terminals 21 include three differential signal pairs, and the second terminals 22 include one differential signal pair. The end portions 211 of the first terminals 21 and the end portions 221 of second terminals 22 extend vertically with respect to the top portion 11. The bottom portion 13 has forwardly facing stop surfaces 131 formed at the front side and rails 132 formed at the left and right sides. The stop surfaces 131 define the stop positions of the second terminals 22. The housing 10 has channels (not shown) for receiving the rails 132.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a housing having a receptacle for insertion of a plug connector; and a contact module inserted into the receptacle, the contact module having an insulative part, a set of first terminals insert molded with the insulative part and a set of second terminals separately mounted to the insulative part, each of the first and second terminals having one end for mounting to an exterior substrate and another free end, the free ends of the first terminals and the free ends of the second terminals substantially extending along two opposite directions, respectively.

2. The electrical connector as claimed in claim 1, wherein said insulative part has a slot for receiving and holding the second terminal, the receptacle extending along a front-to-back direction, the slot penetrates a front surface of the insulative part along the front-to-back direction.

3. The electrical connector as claimed in claim 2, wherein said second terminal has a barb received in the slot and engaging with the insulative part.

4. The electrical connector as claimed in claim 2, wherein said insulative part is disposed as Z shaped and has a top portion, a bottom portion and a middle portion positioned therebetween.

5. The electrical connector as claimed in claim 4, wherein said top portion has a top slot extending horizontally and said middle portion has a front slot extending vertically.

6. The electrical connector as claimed in claim 4, wherein said insulative part has a notch positioned at an edge thereof between the top portion and the middle portion, and said notch is wider than the slots.

7. The electrical connector as claimed in claim 4, wherein said bottom portion has a forwardly facing stop surface formed at a front side thereof.

8. The electrical connector as claimed in claim 1, wherein said second terminal has a vertical portion retained in the middle portion and a bent portion protruding toward the bottom portion of the insulative part.

9. The electrical connector as claimed in claim 1, wherein said second terminal is assembled to the insulative part along a top-to-bottom direction.

10. The electrical connector as claimed in claim 1, wherein said insulative part has a rail and the housing has a channel receiving the rail.

11. The electrical connector as claimed in claim 1, wherein said set of first terminals include three differential signal pairs, and said second terminal includes one differential signal pair.

12. The electrical connector as claimed in claim 1, further including a spacer having a plurality of holes, the spacer being assembled to the bottom of the housing, the ends for mounting being inserted through corresponding holes.

13. An electrical connector comprising:

an insulative housing defining a horizontal mating cavity extending along a front-to-back direction;

a contact module assembled into the housing and including an insulative part equipped with first set and second set of contacts therewith, each of said first set and second set of contacts defining a front contacting section extending into the mating cavity, and a rear tail section exposed outside of the housing for mounting to an exterior compont, each of the first set of contacts defining a horizontal section extending across the mating cavity in the front-to-back direction with the corresponding contacting section backwardly extending from a front end of the horizontal section in a rearward cantilevered manner with a corresponding free end of said corresponding contacting section located at a level relative far from that defined by the horizontal section, each of the second set of contacts defining no horizontal section extending cross the mating cavity in the front-to-back direction but with the corresponding contacting section extending from a position at a level close to the level defined by the horizontal section in a forward cantilevered manner with a corresponding free end located adjacent to a joint between the contacting section and the horizontal section of each of said first set of contacts in a side view; wherein one set of the first set of contacts and the second set of contacts is insert molded within the insulative part while the other is separately assembled thereto along a vertical direction perpendicular to said front-to-back direction.

14. The electrical connector as claimed in claim 13, wherein each of the second set of contacts defines a vertical retaining section to be secured to the insulative part in the vertical direction.

15. The electrical connector as claimed in claim 13, wherein the rear tail sections of said contacts extend in a vertical direction and are spaced from the insulative part in the front-to-back direction.

16. The electrical connector as claimed in claim 13, wherein each of both said first set and said second set of contacts defines an upside down U-shaped configuration defining a front vertical section parallel to the rear tail section, and the front vertical section of each of the first set of contacts embedded within the insulative part while that of the each of the second set of contacts is exposed to the horizontal mating cavity.

17. An electrical connector comprising:

an insulative housing defining a horizontal mating cavity extending along a front-to-back direction;

a contact module assembled into the housing and including an insulative part equipped with first set and second set of contacts therewith, each of said first set and second set of contacts defining a front contacting section extending into the mating cavity, and a rear tail section exposed outside of the housing for mounting to an exterior component, each of the first set of contacts defining a horizontal section extending across the mating cavity in the front-to-back direction with the corresponding contacting section backwardly extending from a front end of the horizontal section in a rearward cantilevered manner with a corresponding free end of said corresponding contacting section located at a level relative far from that defined by the horizontal section, each of the second set of contacts defining no horizontal section extending cross the mating cavity in the front-to-back direction but with the corresponding contacting section extending in a forward cantilevered manner with a corresponding free end located adjacent to a joint between the contacting section and the horizontal section of each of said first set of contacts in a side view; wherein all said contacting sections extend obliquely, the first set of contacts are insert molded within the insulative part while the second set of contacts are discretely assembled to the insulative part.

18. The electrical connector as claimed in claim 17, wherein the tail sections of the both sets of contacts and the contacting sections of the second set of contacts extend downwardly while the contacting sections of the first set of contacts extend obliquely and upwardly.

19. The electrical connector as claimed in claim 17, wherein each of both said first set and said second set of contacts defines an upside down U-shaped configuration defining a front vertical section parallel to the rear tail section, and the front vertical section of each of the first set of contacts embedded within the insulative part while that of the each of the second set of contacts is exposed to the horizontal mating cavity.

* * * * *